US012104817B2

(12) United States Patent
Zhuo et al.

(10) Patent No.: US 12,104,817 B2
(45) Date of Patent: Oct. 1, 2024

(54) CONTROL METHOD FOR MULTI-SPLIT AIR CONDITIONING SYSTEM CAPABLE OF SIMULTANEOUS COOLING AND HEATING

(71) Applicants: Qingdao Haier Air-conditioning Electronic Co., Ltd, Qingdao (CN); Haier Smart Home Co., Ltd., Qingdao (CN)

(72) Inventors: Baitian Zhuo, Qingdao (CN); Bin Shi, Qingdao (CN); Shaojiang Cheng, Qingdao (CN); Ruigang Zhang, Qingdao (CN); Jun Wang, Qingdao (CN)

(73) Assignees: Qingdao Haier Air-conditioning Electronic Co., Ltd, Qingdao (CN); Haier Smart Home Co., Ltd., Qingdao (CN)

( * ) Notice: Subject to any disclaimer, the term of this patent is extended or adjusted under 35 U.S.C. 154(b) by 271 days.

(21) Appl. No.: 17/637,260

(22) PCT Filed: Aug. 17, 2020

(86) PCT No.: PCT/CN2020/109557
§ 371 (c)(1),
(2) Date: Feb. 22, 2022

(87) PCT Pub. No.: WO2021/036842
PCT Pub. Date: Mar. 4, 2021

(65) Prior Publication Data

US 2022/0307720 A1 Sep. 29, 2022

(30) Foreign Application Priority Data

Aug. 30, 2019 (CN) ..... 201910815570.9

(51) Int. Cl.
*F24F 11/65* (2018.01)
*F24F 11/84* (2018.01)
*F24F 110/10* (2018.01)

(52) U.S. Cl.
CPC ..... *F24F 11/65* (2018.01); *F24F 11/84* (2018.01); *F24F 2110/10* (2018.01)

(58) Field of Classification Search
CPC ..... F24F 11/65; F24F 11/84; F24F 2110/10; F24F 2140/50; F24F 3/065; F24F 2221/54; F24F 11/64
See application file for complete search history.

(56) References Cited

U.S. PATENT DOCUMENTS 5,613,369 A * 3/1997 Sato ..... F24F 11/62 236/78 D
2003/0074910 A1* 4/2003 Moon ..... F25B 41/20 62/196.4

(Continued)

FOREIGN PATENT DOCUMENTS

CN 104006497 A 8/2014
CN 105698268 A 6/2016

(Continued)

OTHER PUBLICATIONS

International Search Report mailed Nov. 18, 2020, in corresponding to International Application No. PCT/CN2020/109557; 5 pages (with English Translation).

*Primary Examiner* — Nelson J Nieves
(74) *Attorney, Agent, or Firm* — Maier & Maier, PLLC

(57) ABSTRACT

A control method for a multi-split air conditioning system capable of simultaneous cooling and heating to solve the problem that uneven cooling and heating occurs when running an existing multi-split air conditioning system. The method includes calculating the cooling or heating temperature effect deviation of each indoor unit on the basis of the indoor ambient temperature and set temperature of the environment where each indoor unit is located; calculating the total cooling effect deviation and total heating effect deviation of an multi-split air conditioning system on the basis of the horsepower of all the indoor units and the corresponding cooling temperature deviation or heating temperature deviation; and selectively adjusting the degrees of opening of valve boxes on the basis of the total cooling effect deviation and the total heating effect deviation. The method ensures balanced distribution of refrigerant, balanced running effects the units, and avoids uneven heating and cooling.

9 Claims, 3 Drawing Sheets

(56) References Cited

U.S. PATENT DOCUMENTS

| | | | | |
|---|---|---|---|---|
| 2016/0161165 | A1* | 6/2016 | Ushijima | F24F 11/63 62/155 |
| 2016/0252284 | A1* | 9/2016 | Kibo | F24F 11/86 62/115 |
| 2017/0219238 | A1* | 8/2017 | Kibo | F24F 11/84 |
| 2020/0256573 | A1* | 8/2020 | Zhuo | F24F 11/56 |
| 2020/0355415 | A1* | 11/2020 | Yanachi | F25B 13/00 |
| 2021/0215385 | A1* | 7/2021 | Mori | F24F 11/86 |
| 2021/0381714 | A1* | 12/2021 | Hei | F24F 1/0003 |
| 2022/0049871 | A1* | 2/2022 | Bak | F24F 11/54 |

FOREIGN PATENT DOCUMENTS

| | | | | |
|---|---|---|---|---|
| CN | 107726554 | A | | 2/2018 |
| CN | 109237703 | A | | 1/2019 |
| JP | 2003-130425 | A | | 5/2003 |
| JP | 2003207191 | A | * | 7/2003 |
| JP | 2008051466 | A | * | 3/2008 |

* cited by examiner

CONTROL METHOD FOR MULTI-SPLIT AIR CONDITIONING SYSTEM CAPABLE OF SIMULTANEOUS COOLING AND HEATING

FIELD

The present disclosure relates to the technical field of air conditioning, and in particular to a control method for a multi-connection air conditioning system capable of simultaneous cooling and heating.

BACKGROUND

In a multi-connection air conditioning system capable of simultaneous cooling and heating, a plurality of valve boxes are connected to an outdoor unit, and a plurality of indoor units are connected to each of the valve boxes at the same time. The valve box is configured to control a flow direction of a refrigerant in the air conditioning system. Each of the valve boxes generally has a high-pressure valve and a low-pressure valve therein. These two valves switch between different open/closed states according to working modes of the indoor units connected to the valve box so as to achieve different flow directions of the refrigerant. The plurality of indoor units connected to the same valve box can only operate in the same operating mode, and the plurality of indoor units connected to different valve boxes can operate in different operating modes between the different valve boxes due to different flow directions of the refrigerant, so that in the entire air conditioning system, some indoor units can operate in a cooling mode, and some indoor units can operate in a heating mode.

In order to more accurately control a flow rate and reduce noises generated as the refrigerant flows, electronic expansion valves are generally used as the high-pressure valve and the low-pressure valve. When the indoor unit is operating in the cooling mode, in the corresponding valve box, the high-pressure valve is closed, and the low-pressure valve is fully opened. When the indoor unit is operating in the heating mode, in the corresponding valve box, the high-pressure valve is fully opened, and the low-pressure valve is closed. When there are both cooling and heating indoor units in the multi-connection air conditioning system, since the numbers and capacities of the indoor units connected to individual valve boxes are not exactly the same, if an opening degree of the high-pressure valve or the low-pressure valve in the valve box is always fixed, this will result in uneven heating and cooling between different indoor units when the air conditioning system is operating, which will seriously affect the user's use experience.

Accordingly, there is a need in the art for a new control method for a multi-connection air conditioning system capable of simultaneous cooling and heating to solve the above problem.

SUMMARY

In order to solve the above problem in the prior art, that is, to solve the problem that existing multi-connection air conditioning systems capable of simultaneous cooling and heating are prone to uneven cooling and heating during operation, the present disclosure provides a control method for a multi-connection air conditioning system capable of simultaneous cooling and heating, in which the multi-connection air conditioning system capable of simultaneous cooling and heating includes an outdoor unit, a plurality of valve boxes and a plurality of indoor units, the outdoor unit and the plurality of indoor units are connected through the plurality of valve boxes, and each of the valve boxes has at least one of the indoor units connected therewith; the control method includes:

calculating a cooling temperature effect deviation or a heating temperature effect deviation of each of the indoor units based on an indoor environment temperature of an environment in which the indoor unit is located and a set temperature;

calculating a total cooling effect deviation and a total heating effect deviation of the multi-connection air conditioning system based on horsepowers of all the indoor units and the corresponding cooling temperature effect deviations or heating temperature effect deviations; and selectively adjusting opening degrees of the valve boxes based on the total cooling effect deviation and the total heating effect deviation.

In a preferred technical solution of the above control method for the multi-connection air conditioning system capable of simultaneous cooling and heating, the step of "selectively adjusting the opening degrees of the valve boxes based on the total cooling effect deviation and the total heating effect deviation" further includes:

determining a system correction value of each of the valve boxes based on the total cooling effect deviation and the total heating effect deviation, respectively; and selectively adjusting the opening degrees of the valve boxes based on the system correction values.

In a preferred technical solution of the above control method for the multi-connection air conditioning system capable of simultaneous cooling and heating, the step of "determining the system correction value of each of the valve boxes based on the total cooling effect deviation and the total heating effect deviation respectively" further includes:

calculating a first difference between the total cooling effect deviation and the total heating effect deviation;

judging a relationship of the first difference with a first preset threshold and a second preset threshold; and determining the system correction value of each of the valve boxes based on a correspondence between an operating mode of the outdoor unit, the first difference and the system correction value, if the first difference is smaller than the first preset threshold or larger than the second preset threshold;

in which the first preset threshold is smaller than the second preset threshold, and the operating mode of the outdoor unit includes a cooling mode and a heating mode.

In a preferred technical solution of the above control method for the multi-connection air conditioning system capable of simultaneous cooling and heating, the control method further includes:

calculating a valve box effect deviation of each of the valve boxes based on the horsepowers of all the indoor units connected to the same valve box and the corresponding cooling temperature effect deviations or heating temperature effect deviations; and the step of "selectively adjusting the opening degrees of the valve boxes based on the total cooling effect deviation and the total heating effect deviation" further includes:

selectively adjusting the opening degrees of the valve boxes based on the total cooling effect deviation, the total heating effect deviation, and the valve box effect deviations.

In a preferred technical solution of the above control method for the multi-connection air conditioning system capable of simultaneous cooling and heating, the step of "selectively adjusting the opening degrees of the valve boxes based on the total cooling effect deviation, the total heating effect deviation, and the valve box effect deviations" further includes:

determining a system correction value of each of the valve boxes based on the total cooling effect deviation and the total heating effect deviation, respectively;

determining a local correction value of each of the valve boxes based on the valve box effect deviation, respectively;

calculating a final correction value of each of the valve boxes based on the system correction value and the local correction value; and selectively adjusting the opening degree of the valve box based on the final correction value.

In a preferred technical solution of the above control method for the multi-connection air conditioning system capable of simultaneous cooling and heating, the step of "determining the system correction value of each of the valve boxes based on the total cooling effect deviation and the total heating effect deviation respectively" further includes:

calculating a first difference between the total cooling effect deviation and the total heating effect deviation;

judging a relationship of the first difference with a first preset threshold and a second preset threshold; and determining the system correction value of each of the valve boxes based on a correspondence between an operating mode of the outdoor unit, the first difference and the system correction value, if the first difference is smaller than the first preset threshold or larger than the second preset threshold;

in which the first preset threshold is smaller than the second preset threshold, and the operating mode of the outdoor unit includes a cooling mode and a heating mode.

In a preferred technical solution of the above control method for the multi-connection air conditioning system capable of simultaneous cooling and heating, the step of "determining the local correction value of each of the valve boxes based on the valve box effect deviation respectively" further includes:

calculating a second difference between a maximum value of the valve box effect deviations and a minimum value of the valve box effect deviations of all the valve boxes in the same working state;

judging a relationship between the second difference and a third preset threshold;

calculating an average effect deviation value of all the valve boxes in the same working state based on the valve box effect deviation of each of the valve boxes in the same working state and the number of the valve boxes in the same working state, if the second difference is larger than the third preset threshold;

comparing a magnitude of the valve box effect deviation of each of the valve boxes in the same working state with a magnitude of the corresponding average effect deviation value; and determining the local correction value of each of the valve boxes in the same working state based on a comparison result, respectively;

in which the working state of the valve box includes a cooling state and a heating state.

In a preferred technical solution of the above control method for the multi-connection air conditioning system capable of simultaneous cooling and heating, the step of "calculating the final correction value of each of the valve boxes based on the system correction value and the local correction value" further includes:

calculating a sum of a weighted value of the system correction value and a weighted value of the local correction value as the final correction value.

In a preferred technical solution of the above control method for the multi-connection air conditioning system capable of simultaneous cooling and heating, when adjusting the opening degree of the valve box, the control method further includes:

judging whether the adjusted opening degree of the valve box is smaller than a minimum opening degree limit; and if yes, adjusting the opening degree of the valve box to the minimum opening degree limit.

In a preferred technical solution of the above control method for the multi-connection air conditioning system capable of simultaneous cooling and heating, each of the valve boxes includes a high-pressure valve and a low-pressure valve, and the step of "adjusting the opening degree of the valve box" further includes:

adjusting the opening degree of the high-pressure valve or the low-pressure valve which is in an open state in the valve box.

It can be understood by those skilled in the art that in the preferred technical solutions of the present disclosure, the multi-connection air conditioning system capable of simultaneous cooling and heating includes an outdoor unit, a plurality of valve boxes and a plurality of indoor units, the outdoor unit and the plurality of indoor units are connected through the plurality of valve boxes, and each of the valve boxes has at least one of the indoor units connected therewith; the control method includes: calculating a cooling temperature effect deviation or a heating temperature effect deviation of each of the indoor units based on an indoor environment temperature of an environment in which the indoor unit is located and a set temperature of the environment; calculating a total cooling effect deviation and a total heating effect deviation of the multi-connection air conditioning system based on horsepowers of all the indoor units and the corresponding cooling temperature effect deviations or heating temperature effect deviations; and selectively adjusting opening degrees of the valve boxes based on the total cooling effect deviation and the total heating effect deviation.

During the operation of the multi-connection air conditioning system capable of simultaneous cooling and heating, a system correction value of each of the valve boxes is determined based on the total cooling effect deviation and the total heating effect deviation of the air conditioning system, and the opening degree of each of the valve boxes is dynamically adjusted in real time based on the system correction value; therefore, the control method of the present disclosure can ensure a balanced distribution of refrigerant amount of the system so as to ensure a balanced operating effect of the indoor units, which avoids uneven heating and cooling of the multi-connection air conditioning system during operation.

Further, at the same time of determining the system correction value of each of the valve boxes, a local correction value of each of the valve boxes is also determined based on the effect deviation of the valve box, and then a final correction value of each of the valve boxes is calculated based on the system correction value and the local correction value. In this way, the control method of the present disclosure can further improve the control accuracy of the valve box, control the opening degree of the valve box more accurately, and ensure a balanced operating effect of the indoor units.

Further, by judging whether the adjusted opening degree of the valve box is smaller than an opening degree limit when adjusting the opening degree of the valve box, the control method of the present disclosure can also ensure the most basic operating effect of each indoor unit, and prevent abnormal situations such as no refrigerant flow rate caused by the opening degree of the valve box being too small.

BRIEF DESCRIPTION OF DRAWINGS

A control method for a multi-connection air conditioning system capable of simultaneous cooling and heating of the present disclosure will be described below with reference to the accompanying drawings. In the drawings.

DETAILED DESCRIPTION

Preferred embodiments of the present disclosure will be described below with reference to the accompanying drawings. It should be understood by those skilled in the art that these embodiments are only used to explain the technical principles of the present disclosure, and are not intended to limit the scope of protection of the present disclosure. Although various steps are described in the above sequential order in the above embodiments, those skilled in the art can understand that in order to achieve the effects of the present embodiment, different steps need not be executed in such an order, and they may be executed at the same time (in parallel) or in a reverse order. These simple changes are all within the scope of protection of the present disclosure. For example, in the second embodiment, although step S202 is executed prior to step S203, it is obvious that the order of executing these two steps can be reversed, and the control method after the reversal does not deviate from the scope of protection of the present application.

First Embodiment

Figure 1:
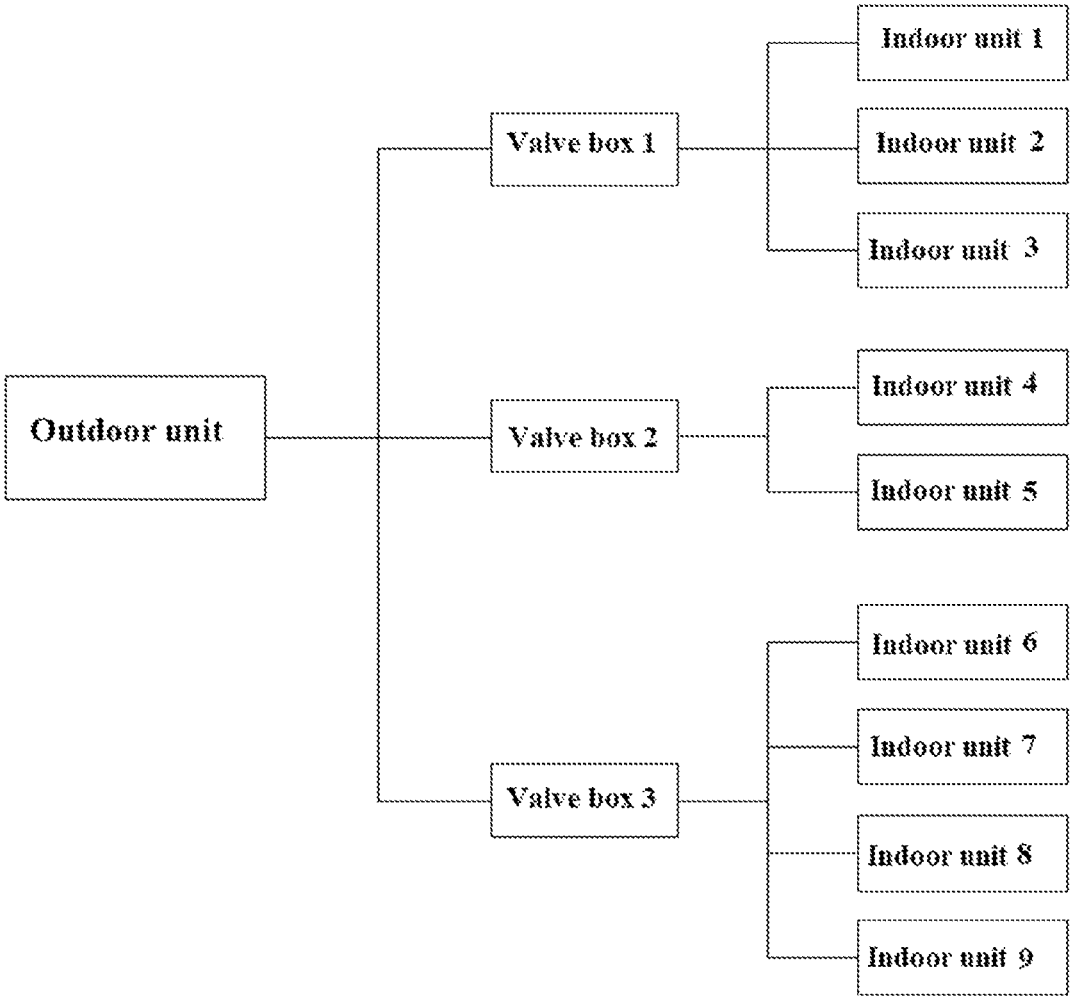
FIG. 1 is a schematic connection diagram of a multi-connection air conditioning system capable of simultaneous cooling and heating in the prior art.

First, referring to FIG. 1, a multi-connection air conditioning system in the prior art will be introduced. FIG. 1 is a schematic connection diagram of a multi-connection air conditioning system capable of simultaneous cooling and heating in the prior art. As shown in FIG. 1, in the prior art, an outdoor unit of the multi-connection air conditioning system capable of simultaneous cooling and heating is connected to a plurality of indoor units through a plurality of valve boxes. In FIG. 1, three valve boxes are provided, namely, valve box 1 to valve box 3; and nine indoor units are provided, namely, indoor unit 1 to indoor unit 9 as shown. The valve box 1 is connected with the indoor unit 1 to the indoor unit 3, the valve box 2 is connected with the indoor unit 4 to the indoor unit 5, and the valve box 3 is connected with the indoor unit 6 to the indoor unit 9. Each valve box is usually provided therein with only one high-pressure valve and one low-pressure valve (not shown in the figure), and electronically controlled valves such as solenoid valves or electronic expansion valves may be used as the high-pressure valve and the low-pressure valve. A first end of the high-pressure valve is connected to a high-pressure side of a compressor in the outdoor unit through a high-pressure air pipe, a first end of the low-pressure valve is connected to a low-pressure side of the compressor through a low-pressure air pipe, and a second end of the high-pressure valve and a second end of the low-pressure valve converge at an indoor-side air pipe and are connected to a heat exchanger of the indoor unit through the indoor-side air pipe.

When the multi-connection air conditioning system is operating, the cooling or heating operation of the indoor units can be realized by switching the opening and closing of the high-pressure valves and the low-pressure valves in the valve boxes. In addition, the plurality of indoor units connected to the same valve box can only operate in the same operating mode, but the indoor units connected to different valve boxes can operate in a different operating mode. For example, when the indoor unit 1 is operating in the cooling mode, the indoor unit 2 and the indoor unit 3 can only operate in the cooling mode, or they are in a standby state; and when the indoor unit 1 is operating in the cooling mode, the indoor unit 4 and the indoor unit 6 can operate either in the cooling mode or in the heating mode.

As described in the "BACKGROUND", when there are cooling indoor units and heating indoor units operating at the same time in the multi-connection air conditioning system, since the numbers and capacities of the indoor units connected to individual valve boxes are not the same, this will result in uneven heating and cooling between different indoor units, which will seriously affect the user's use experience.

Figure 2:
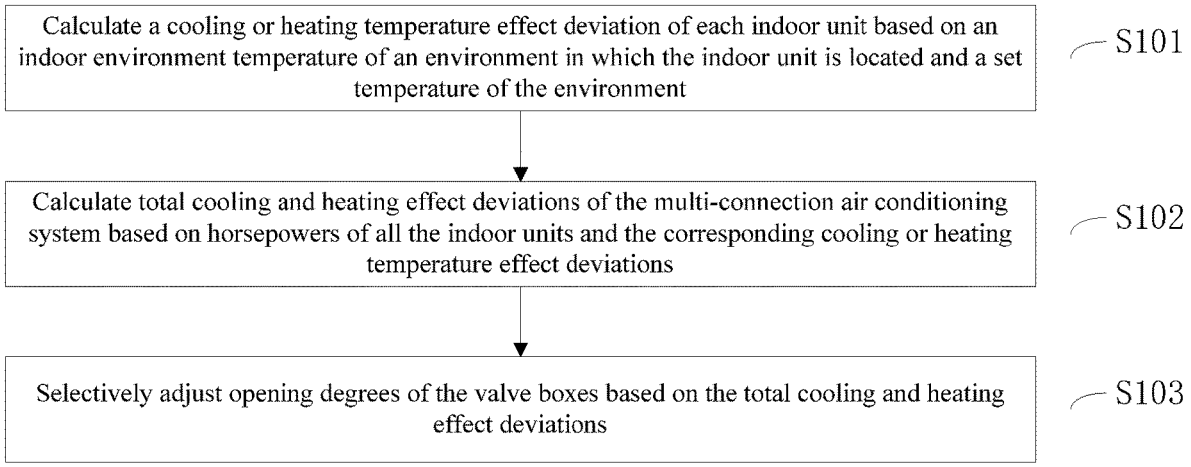
FIG. 2 is a flowchart of a control method for a multi-connection air conditioning system capable of simultaneous cooling and heating in a first embodiment of the present disclosure.

Next, referring to FIG. 2, a first embodiment of the control method for the multi-connection air conditioning system capable of simultaneous cooling and heating of the present application will be described. FIG. 2 is a flowchart of the control method for the multi-connection air conditioning system capable of simultaneous cooling and heating in the first embodiment of the present disclosure.

As shown in FIG. 2, in order to solve the above technical problem, the control method for the multi-connection air conditioning system capable of simultaneous cooling and heating of the present application mainly includes the following steps:

S101: calculating a cooling temperature effect deviation or a heating temperature effect deviation of each of the indoor units based on an indoor environment temperature of an environment in which the indoor unit is located and a set temperature of the environment;

S102: calculating a total cooling effect deviation and a total heating effect deviation of the multi-connection air conditioning system based on horsepowers of all the indoor units and the corresponding cooling temperature effect deviations or heating temperature effect deviations; and S103: selectively adjusting opening degrees of the valve boxes based on the total cooling effect deviation and the total heating effect deviation.

In step S101, the cooling temperature effect deviation and the heating temperature effect deviation in the present application refer to a deviation amount of the indoor environment temperature of a room in which the indoor unit is located relative to a set temperature. Specifically, the cooling temperature effect deviation refers to a deviation between the indoor environment temperature of the room in which the indoor unit operating in the cooling mode is located and the set temperature of the room; and the heating temperature effect deviation refers to a deviation between the set temperature of the room in which the indoor unit operating in the heating mode is located and the indoor environment temperature of the room. More preferably, the indoor environment temperature of the room in which the operating indoor unit is located can be collected through a temperature sensor provided on the indoor unit, and the set temperature can be collected through set parameter information of the indoor unit; then the cooling temperature effect deviation or the heating temperature effect deviation of each operating indoor unit is calculated based on the following formulas (1) and (2) respectively:

$$CoolIUdiff = \frac{curTemp - setTemp}{setTemp} \times 100\%; \quad (1)$$

$$HeatIUdiff = \frac{setTemp - curTemp}{setTemp} \times 100\%. \quad (2)$$

In formulas (1) and (2), CoolIUdiff represents the cooling temperature effect deviation; HeaTIUdiff represents the heating temperature effect deviation; setTemp represents the set temperature of the room; and curTemp represents the current indoor environment temperature of the room.

Of course, in addition to calculating the deviation by using the above formulas, any calculation method that can reflect the deviation amount between the current indoor environment temperature and the set temperature can be substituted. For example, the difference between the indoor environment temperature and the set temperature is used as the deviation amount, etc. Moreover, in addition to performing the collection and calculation only on the operating indoor units, the indoor environment temperatures and set temperatures of all the indoor units may also be collected, and the cooling temperature effect deviations or heating temperature effect deviations of all the indoor units may also be calculated. During the calculation process, the cooling temperature effect deviations or heating temperature effect deviations of the indoor units that are not operating can be directly set to zero.

In step S102, the total cooling effect deviation in the present application refers to a deviation amount of a sum of cooling capacities corresponding to the cooling temperature effect deviations of all the indoor units operating in the cooling mode relative to a total cooling capacity of all the indoor units operating in the cooling mode. Correspondingly, the total heating effect deviation in the present application refers to a deviation amount of a sum of heating capacities corresponding to the heating temperature effect deviations of all the indoor units operating in the heating mode relative to a total heating capacity of all the indoor units operating in the heating mode. Specifically, the following formulas (3) and (4) can be used to calculate the total cooling effect deviation and the total heating effect deviation:

$$CoolDiff = \frac{\sum(CoolIUdiff \times HP)}{CoolsumHP} \times 100\%; \quad (3)$$

$$HeatDiff = \frac{\sum(HeatIUdiff \times HP)}{HeatsumHP} \times 100\%. \quad (4)$$

In formulas (3) and (4), CoolDiff represents the total cooling effect deviation; HeaTDIff represents the total heating effect deviation; CoolIUdiff represents the cooling temperature effect deviation; HeaTIUdiff represents the heating temperature effect deviation; HP represents the horsepower of the indoor unit corresponding to the cooling temperature effect deviation or the heating temperature effect deviation; CoolsumHP represents the sum of the horsepowers of all the indoor units operating in the cooling mode; and HeatsumHP represents the sum of the horsepowers of all the indoor units operating in the heating mode.

In step S103, adjusting the opening degree of the valve box refers to adjusting the opening degree of the high-pressure valve or the low-pressure valve in the open state in the valve box. Since the high-pressure valve and the low-pressure valve cannot be opened at the same time when the valve box is working and usually only one of them is in the open state, adjusting the opening degree of the valve box means adjusting the opening degree of the valve in the open state. For example, if the plurality of indoor units connected to the valve box are operating in the cooling mode, then the working state of the valve box is the cooling state at this time. In this situation, usually, the high-pressure valve in the valve box is closed and the low-pressure valve is open. On the contrary, if the plurality of indoor units connected to the valve box are operating in the heating mode, then the working state of the valve box is the heating state at this time. In this situation, usually, the high-pressure valve in the valve box is open and the low-pressure valve is closed.

In a possible embodiment, step S103 may further include: determining a system correction value of each of the valve boxes based on the total cooling effect deviation and the total heating effect deviation, respectively; and selectively adjusting the opening degrees of the valve boxes based on the system correction values. Specifically, a first difference between the total cooling effect deviation and the total heating effect deviation is first calculated as an overall deviation of the air conditioning system; then a relationship of the first difference with a first preset threshold and a second preset threshold is judged; if the first difference is smaller than the first preset threshold or larger than the second preset threshold, the system correction value of each of the valve boxes is determined respectively based on a correspondence between an operating mode of the outdoor unit and the system correction value; the opening degree of the valve box is adjusted based on the system correction value; and if the first difference is larger than the first preset threshold and smaller than the second preset threshold, the current opening degree of the valve box is maintained. The first preset threshold is smaller than the second preset threshold, and the operating mode of the outdoor unit includes a cooling mode and a heating mode. The system correction value is in the form of percentage of opening degree in the present application, and of course it may also be the value of opening degree.

For example, first, the first preset threshold and the second preset threshold may be set to −10% and 10% respectively (both of them may be adjusted based on actual conditions), and then the following formula (5) is used to calculate the overall deviation of the air conditioning system:

$$SysDiff = CoolDiff - HeatDiff \quad (5).$$

In formula (5), SysDiff represents the overall deviation of the air conditioning system; CoolDiff represents the total cooling effect deviation; and HeaTDiff represents the total heating effect deviation.

Of course, in addition to using the difference between the total cooling effect deviation and the total heating effect deviation, the overall deviation may also be calculated by using a ratio of the total cooling effect deviation and the total heating effect deviation, etc. Such adjustments to the calculation method do not deviate from the principle of the present application.

After the overall deviation SysDiff is calculated, the overall deviation SysDiff may be compared with two preset thresholds of −10% and 10%; if −10%≤SysDiff≤10%, it proves that the overall deviation of the air conditioning system is within a reasonable range, and the cooling and heating effects are relatively balanced between different indoor units. In this case, there is no need to adjust the opening degrees of the valve boxes, and it is only required to control the valve boxes to maintain the current openings thereof, that is, the system correction values of the valve boxes are determined to be zero. If SysDiff<−10% or SysDiff>10%, it proves that the deviation of the air conditioning system is relatively large at this time, and the opening degrees of the valve boxes need to be adjusted.

Specifically, if SysDiff<−10%, it proves that the heating effect in the multi-connection air conditioning system is worse than the cooling effect at this time. Therefore, it is necessary to reduce the opening degrees of the low-pressure valves in the valve boxes in the cooling state and increase the opening degrees of the high-pressure valves in the valve boxes in the heating state to adjust the flow rate of the refrigerant, so as to balance the cooling and heating effects of the multi-connection air conditioning system. At this time, the system correction value (i.e., the magnitude of adjusting the opening degree) can be determined through a correspondence between the operating mode of the outdoor unit, the overall deviation and the system correction value. The operating mode of the outdoor unit includes a cooling mode and a heating mode. When the heat exchanger in the outdoor unit is used as a condenser, the operating mode is the cooling mode, and when the heat exchanger in the outdoor unit is used as an evaporator, the operating mode is the heating mode. For example, SysCoolFixVal and SysHeatFixVal represent the system correction value of the valve box in the cooling state and the heating state respectively. When the outdoor unit is in the cooling mode, SysCoolFixVal=2% and SysHeatFixVal=5% can be adopted. When the outdoor unit is in the heating mode, SysCoolFixVal=5% and SysHeatFixVal=2% can be adopted. After the system correction value is determined based on the correspondence between the operating mode of the outdoor unit and the system correction value, the opening degree of the valve box is adjusted based on the aforementioned adjustment ratio.

The specific numerical value of the system correction value may be determined based on experiment or experience. For example, based on the operating modes of different outdoor units and the overall deviation SysDiff, multiple times of adjustment experiment are performed on the opening degrees of the valve boxes, adjustment values of the valve boxes in the cooling state and the heating state are recorded respectively, and the overall deviation of the multi-connection air conditioning system after the adjustment is calculated. If the value of the overall deviation is between the first preset threshold and the second preset threshold, the adjustment values of each valve box in the cooling state and each valve box in the heating state in this experiment are record as the system correction values corresponding to the operating mode of the outdoor unit and the overall deviation.

It should be noted that the specific numerical value of the above-mentioned system correction value is only used to explain the principle of the present disclosure, and is not intended to limit the scope of protection of the present application. Those skilled in the art may adjust the numerical value so that the present application can be adapted to a more specific application scene.

In contrast, when SysDiff>10%, it proves that the cooling effect in the multi-connection air conditioning system is worse than the heating effect at this time. Therefore, it is necessary to increase the opening degrees of the low-pressure valves in the valve boxes in the cooling state and reduce the opening degrees of the high-pressure valves in the valve boxes in the heating state to adjust the flow rate of the refrigerant, so as to balance the cooling and heating effects of the multi-connection air conditioning system. At this time, the system correction value (i.e., the magnitude of adjusting the opening degree) can also be determined through the correspondence between the operating mode of the outdoor unit and the system correction value. For example, when the outdoor unit is in the cooling mode, SysCoolFixVal=2% and SysHeatFixVal=5% can also be adopted. When the outdoor unit is in the heating mode, SysCoolFixVal=5% and SysHeatFixVal=2% can also be adopted. After the system correction value is determined based on the correspondence between the operating mode of the outdoor unit and the system correction value, the opening degree of the valve box is adjusted based on the aforementioned adjustment ratio. The specific numerical value of the system correction value may also be determined based on experiment or experience, and a detailed description is omitted herein.

In addition, in the process of adjusting the opening degree of the valve box, in order to ensure the most basic operating effect and avoid abnormalities such as no refrigerant flow due to the opening degree of the valve box being too small, it is also possible to add a judging step to the adjusted opening degree of the valve box; that is, when adjusting the opening degree of the valve box, the control method further includes: judging whether the adjusted opening degree of the valve box is smaller than a minimum opening degree limit; if yes, adjusting the opening degree of the valve box to the minimum opening degree limit; and if not, adjusting the opening degree of the valve box according to the system correction value. The minimum opening degree limit may be set artificially or determined based on experiments.

During the operation of the multi-connection air conditioning system capable of simultaneous cooling and heating, a system correction value of each of the valve boxes is determined based on the total cooling effect deviation and the total heating effect deviation of the air conditioning system, and the opening degree of each of the valve boxes is dynamically adjusted in real time based on the system correction value; therefore, the control method of the present disclosure can ensure a balanced distribution of refrigerant amount of the system so as to ensure a balanced operating effect of the indoor units, which avoids uneven heating and cooling of the multi-connection air conditioning system during operation.

Second Embodiment

Figure 3:
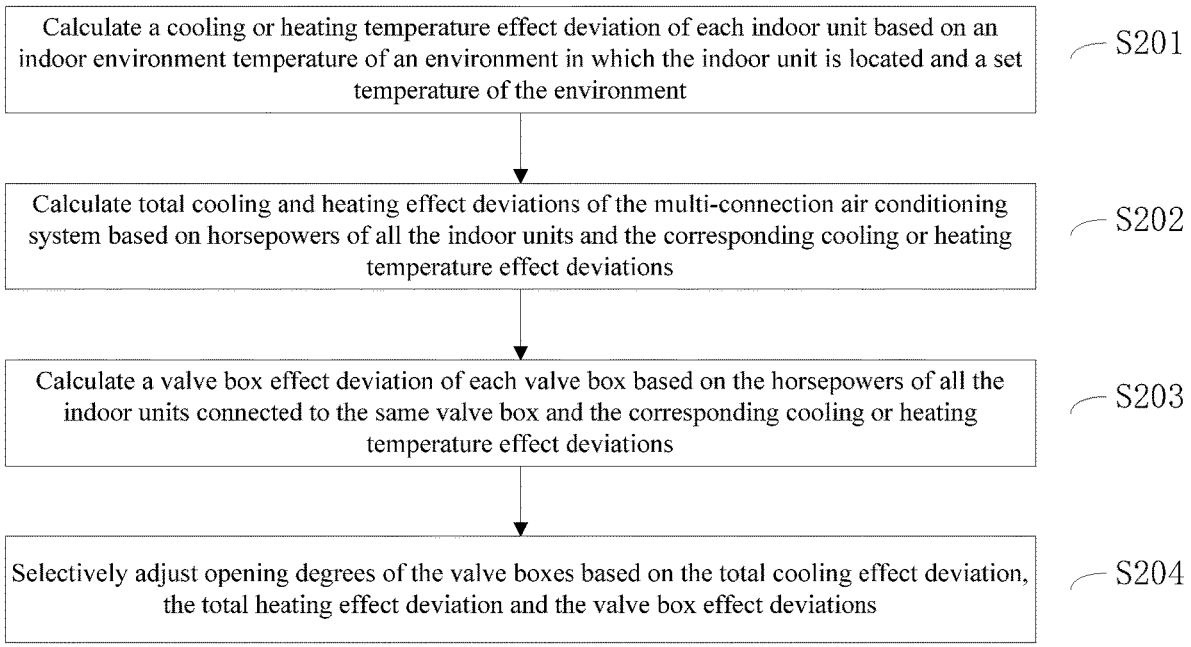
FIG. 3 is a flowchart of a control method for a multi-connection air conditioning system capable of simultaneous cooling and heating in a second embodiment of the present disclosure.

Next, referring to FIG. 3, a second embodiment of the control method for the multi-connection air conditioning system capable of simultaneous cooling and heating of the present application will be described. FIG. 3 is a flowchart of the control method for the multi-connection air conditioning system capable of simultaneous cooling and heating in the second embodiment of the present disclosure.

As shown in FIG. 3, in order to solve the above technical problem, the control method for the multi-connection air conditioning system capable of simultaneous cooling and heating of the present application mainly includes the following steps:

S201: calculating a cooling temperature effect deviation or a heating temperature effect deviation of each of the indoor units based on an indoor environment temperature of an environment in which the indoor unit is located and a set temperature of the environment;

S202: calculating a total cooling effect deviation and a total heating effect deviation of the multi-connection air conditioning system based on horsepowers of all the indoor units and the corresponding cooling temperature effect deviations or heating temperature effect deviations;

S203: calculating a valve box effect deviation of each of the valve boxes based on the horsepowers of all the indoor units connected to the same valve box and the corresponding cooling temperature effect deviations or heating temperature effect deviations; and

S204: selectively adjusting opening degrees of the valve boxes based on the total cooling effect deviation, the total heating effect deviation and the valve box effect deviations.

The main difference of this embodiment from the first embodiment is that when adjusting the opening degree of the valve box, the valve box effect deviation of each valve box is introduced, and the valve box effect deviation is used as a judgment parameter together with the total cooling effect deviation and the total heating effect deviation so as to selectively adjust the opening degree of the valve box.

The implementation process of steps S201 and S202 in this embodiment is similar to that of steps S101 and S102 in the first embodiment, so a repeated description will be omitted herein. This embodiment mainly focuses on the differences from the first embodiment.

In step S203, the valve box effect deviation in the present application refers to a deviation amount of the sum of the cooling/heating capacities corresponding to the cooling/heating temperature effect deviations of all the indoor units connected to the same valve box relative to the total cooling/heating capacity of all the indoor units connected to the same valve box; specifically, the following formulas (6) and (7) can be used to calculate the valve box effect deviation of the valve box in the cooling/heating state:

$$CoolBSdiff = \frac{\sum(CoolIUdiff \times HP)}{CoolBSsumHP} \times 100\%; \quad (6)$$

$$HeatBSdiff = \frac{\sum(HeatIUdiff \times HP)}{HeatBSsumHP} \times 100\%. \quad (7)$$

In formulas (6) and (7), CoolBSdiff represents the valve box effect deviation of the valve box in the cooling state; HeaTBSdiff represents the valve box effect deviation of the valve box in the heating state; CoolIUdiff represents the cooling temperature effect deviation; HeaTIUdiff represents the heating temperature effect deviation; HP represents the horsepower of the indoor unit corresponding to the cooling temperature effect deviation or heating temperature effect deviation; CoolBSsumHP represents the sum of the horsepowers of all the operating indoor units connected to the same valve box in the cooling state; and HeatBSsumHP represents the sum of the horsepowers of all the operating indoor units connected to the same valve box in the heating state.

In a possible embodiment, step S204 may further include: determining a system correction value of each of the valve boxes based on the total cooling effect deviation and the total heating effect deviation, respectively; determining a local correction value of each of the valve boxes based on the valve box effect deviation, respectively; calculating a final correction value of each of the valve boxes based on the system correction value and the local correction value; and selectively adjusting the opening degree of the valve box based on the final correction value. The steps of calculating the system correction value of each of the valve boxes are the same as or similar to those of the first embodiment, and a repeated description will be omitted herein. The step of calculating the local correction value of each of the valve boxes specifically includes: calculating a second difference between a maximum value of the valve box effect deviations and a minimum value of the valve box effect deviations of all the valve boxes in the same working state as a local deviation of the valve box in this working state; judging a relationship between the local deviation and a third preset threshold; calculating an average effect deviation value of all the valve boxes in the same working state based on the valve box effect deviation of each of the valve boxes in the same working state and the number of the valve boxes in the same working state, if the local deviation is larger than the third preset threshold; comparing a magnitude of the valve box effect deviation of each of the valve boxes in the same working state with a magnitude of the corresponding average effect deviation value; determining the local correction value of each of the valve boxes in the same working state based on a comparison result, respectively; and controlling the valve box to maintain the current opening degree if the local deviation is smaller than the third preset threshold; in which the working state of the valve box includes a cooling state and a heating state.

In the following, the valve box in the cooling state will be used as an example to illustrate the calculation process of the local correction value:

The third set threshold is set to 5% (which may be adjusted based on actual conditions). After the valve box effect deviations of all the valve boxes in the cooling state have been calculated, the following formula (8) is first used to calculate the local deviation of the valve box in the cooling state:

$$PartCoolDiff = CoolMaxBSdiff - CoolMinBSdiff \quad (8).$$

In formula (8), PartCoolDiff represents the local deviation of the valve box in the cooling state; CoolMaxBSdiff and CoolMinBSdiff respectively represent the maximum value and the minimum value of the valve box effect deviations of all the valve boxes in the cooling state.

After the local deviation is calculated, the local deviation PartCoolDiff can be compared with 5%; if PartCoolDiff, it proves that the local deviation is within a reasonable range, and the cooling effects of the indoor units operating in the cooling mode are relatively balanced. At this time, there is no need to adjust the opening degrees of the valve boxes in the cooling state, and it is only required to control the valve boxes to maintain the current opening degrees, that is, the local correction value of each valve box is determined to be zero. If PartCoolDiff>5%, it proves that the cooling effects have a relatively large deviation between the indoor units operating in the cooling mode at this time, and the opening degrees of the valve boxes in the cooling state need to be adjusted.

Specifically, if PartCoolDiff>5%, the following formula (9) is first used to calculate the average effect deviation value of all the valve boxes in the cooling state:

$$PartCoolAVG = \frac{\sum CoolBSdiff}{M}. \quad (9)$$

In formula (9), PartCoolAVG represents the average effect deviation value; CoolBSdiff represents the valve box effect deviation of the valve box in the cooling state; and M is the number of the valve boxes in the cooling state.

After the average effect deviation value PartCoolAVG has been calculated, the valve box effect deviation CoolBSdiff of each valve box in the cooling state is compared with the average effect deviation value PartCoolAVG; if CoolBSdiff>PartCoolAVG, it proves that the indoor unit corresponding to the valve box has a poor cooling effect, and it is necessary to increase the opening degree of the low-pressure valve in the valve box to increase the cooling effect of the corresponding indoor unit; and if CoolBSdiff<PartCoolAVG, it proves that the indoor unit corresponding to the valve box has a good cooling effect, and it is necessary to reduce the opening degree of the low-pressure valve in the valve box to reduce the cooling effect of the corresponding indoor unit, finally achieving a balanced cooling effect of all the indoor units operating in the cooling mode. The calculation process of the local correction values of the valve boxes in the heating state is similar to the calculation process of the local correction values of the valve boxes in the cooling states, and a repeated description will be omitted herein.

In this embodiment, PartCoolFixVal and PartHeatFixVal may be used to represent the local correction values of the valve boxes in the cooling state and the heating state respectively. For example, SysCoolFixVal=3% and SysHeatFixVal=4% may be adopted. The specific numerical value of the local correction value may be determined based on experiment or experience, and its determination method is similar to that of the above system correction value, so a repeated description will be omitted herein. In addition, the specific numerical value of the above-mentioned local correction value is only used to explain the principle of the present disclosure, and is not intended to limit the scope of protection of the present application. Those skilled in the art may adjust the numerical value so that the present application can be adapted to a more specific application scene.

After the system correction value and the local correction value are determined, the step of calculating the final correction value of each of the valve boxes based on the system correction value and the local correction value may further include: calculating a sum of a weighted value of the system correction value and a weighted value of the local correction value as the final correction value of each of the valve boxes. That is, the following formulas (10) and (11) are used to calculate the final correction values of the valve boxes in the cooling state and the valve boxes in the heating state:

$$CoolFixVal=SysCoolFixVal\times CoolRate+PartCoolFixVal\times(1-CoolRate) \quad (10);$$

$$HeatFixVal=SysHeatFixVal\times HeatRate+PartHeatFixVal\times(1-HeatRate) \quad (11).$$

In formulas (10) and (11), CoolFixVal represents the final correction value of the valve box in the cooling state; HeatFixVal represents the final correction value of the valve box in the heating state; SysCoolFixVal and SysHeatFixVal represent the system correction values of the valve boxes in the cooling state and the heating state respectively; PartCoolFixVal and PartHeatFixVal represent the local correction values of the valve boxes in the cooling state and the heating state respectively; CoolRate and HeatRate represent allocation ratio coefficients (i.e., weight coefficients) between the system correction values and the local correction values of the valve boxes in the cooling state and the heating state respectively, which may usually be determined by experience or by experiment. For example, CoolRate=HeatRate=0.6, etc.

After the final correction values of all the valve boxes are determined, the opening degrees of the valve boxes are adjusted based on the final correction values.

In addition, in the process of adjusting the opening degree of the valve box, in order to ensure the most basic operating effect and avoid abnormalities such as no refrigerant flow due to the opening degree of the valve box being too small, it is also possible to add a judging step to the adjusted opening degree of the valve box; that is, when adjusting the opening degree of the valve box, the control method further includes: judging whether the adjusted opening degree of the valve box is smaller than a minimum opening degree limit; if yes, adjusting the opening degree of the valve box to the minimum opening degree limit; and if not, adjusting the opening degree of the valve box according to the final correction value. The minimum opening degree limit may be set artificially or determined based on experiments.

While determining the system correction value of each valve box, the local correction value of each valve box is also determined based on the effect deviation of the valve box, and then the final correction value of each valve box is calculated based on the system correction value and the local correction value. Therefore, the control method of the present disclosure can further improve the control accuracy of the valve box, and realize a more accurate control of the opening degree of the valve box. On the basis of ensuring balanced cooling and heating effects between different indoor units, it is also further ensured that the plurality of indoor units connected to the same valve box have balanced cooling/heating effects therebetween.

Figure 4:
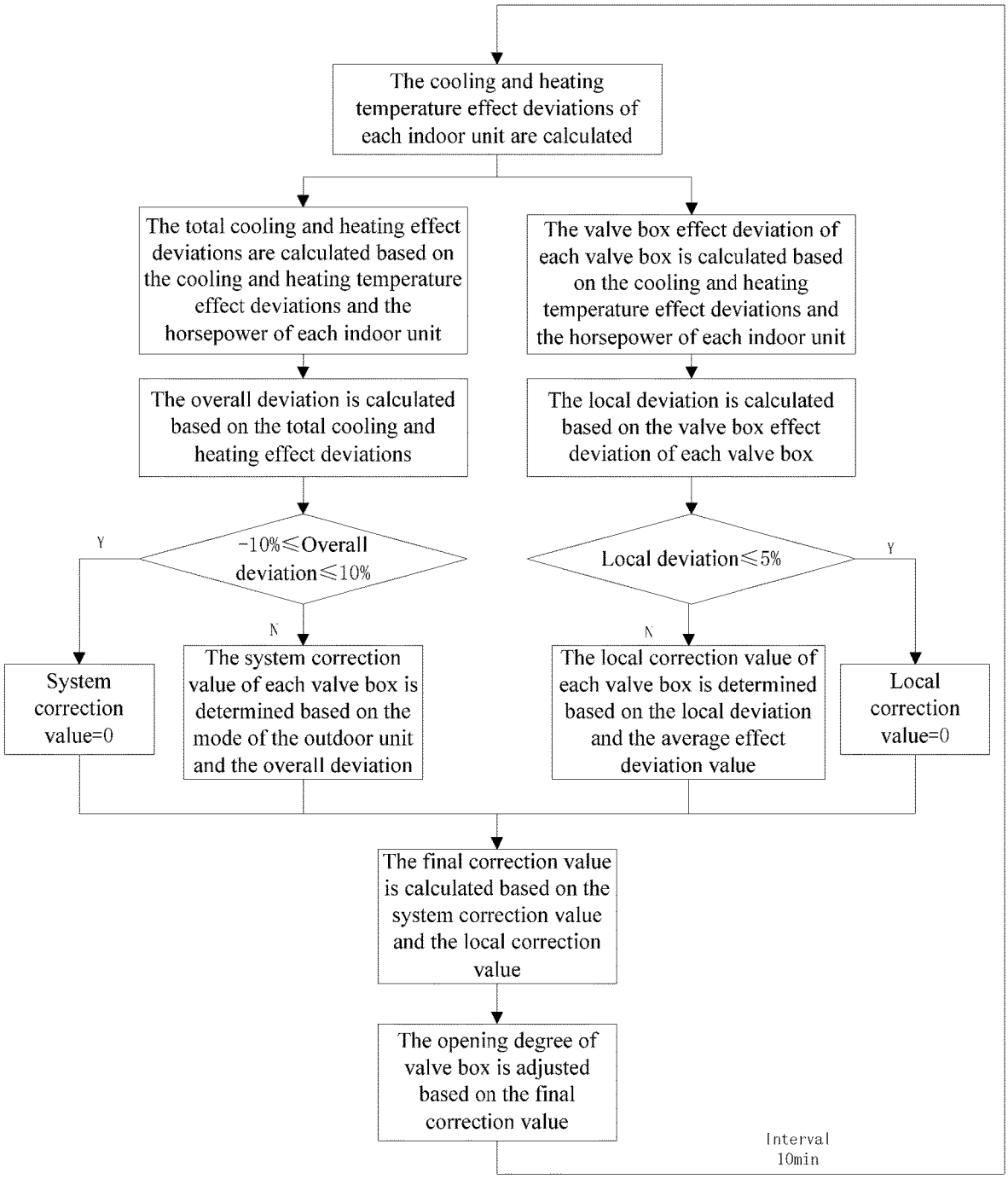
FIG. 4 is a logic diagram of a control method for a multi-connection air conditioning system capable of simultaneous cooling and heating in a possible embodiment of the present disclosure.

With reference to FIG. 4, a brief description of the working process of the multi-connection air conditioning system capable of simultaneous cooling and heating in a possible embodiment of the present disclosure will be given below. FIG. 4 is a logic diagram of a control method for a multi-connection air conditioning system capable of simultaneous cooling and heating in a possible embodiment of the present disclosure.

As shown in FIG. 4, in a possible control process:

(1) the cooling temperature effect deviation and the heating temperature effect deviation of each of the indoor units are calculated based on the set temperatures of the operating indoor units and the corresponding indoor environment temperatures;

(2) the total cooling effect deviation and the total heating effect deviation of the air conditioning system, and the valve box effect deviation of each valve box are calculated respectively based on the cooling temperature effect deviation, the heating temperature effect deviation and the horsepower of each indoor unit;

(3) the overall deviation is calculated based on the total cooling effect deviation and the total heating effect deviation, and a relationship of the overall deviation with the first preset threshold and the second preset threshold is judged; if the overall deviation is between the first preset threshold and the second preset threshold, the system correction value is determined to be zero; otherwise, the system correction value of each valve box is determined based on the mode of the outdoor unit and the overall deviation;

(4) based on the valve box effect deviation of each valve box, the local deviation is calculated, and the magnitude of the local deviation is compared with the magnitude of the third preset threshold; if the local deviation is smaller than the third preset threshold, the local correction value is determined to be zero; otherwise, the local correction value of each valve box is determined based on the local deviation and the average effect deviation value;

(5) the final correction value of each valve box is calculated based on the system correction value, the local correction value and the weight coefficients;

(6) the opening degree of each valve box is adjusted based on the final correction value; and (7) the above process is executed again after an interval of 10 minutes.

It can be understood by those skilled in the art that the aforementioned multi-connection air conditioning system capable of simultaneous cooling and heating also includes some other well-known structures, such as processors, controllers, memories, etc., in which the memories include, but are not limited to, a random access memory, a flash memory, a read-only memory, a programmable read-only memory, a volatile memory, a non-volatile memory, a serial memory, a parallel memory or a register, etc., and the processors include, but are not limited to, CPLD/FPGA, DSP, ARM processor, MIPS processor, etc. In order to unnecessarily obscure the embodiments of the present disclosure, these well-known structures are not shown in the drawings.

Each embodiment of the control method of the present disclosure may be implemented by hardware, or by software modules running on one or more processors, or by a combination of the hardware and the software. It should be understood by those skilled in the art that the present disclosure can be implemented as an apparatus or device program (for example, a PC program and a PC program product) for executing part or all of the methods described herein. Such a program for realizing the present disclosure may be stored on a PC-readable medium, or may have the form of one or more signals. Such signals may be downloaded from an Internet website, or provided on carrier signals, or provided in any other form.

It should be noted that although the detailed steps of the method of the present disclosure have been described in detail above, those skilled in the art may combine, divide and exchange the order of the above steps without departing from the basic principles of the present disclosure. Such modified technical solutions do not change the basic idea of the present disclosure, and therefore also fall within the scope of protection of the present disclosure.

Hitherto, the technical solutions of the present disclosure have been described in conjunction with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A control method for a multi-connection air conditioning system capable of simultaneous cooling and heating, the multi-connection air conditioning system capable of simultaneous cooling and heating comprising an outdoor unit, a plurality of valve boxes and a plurality of indoor units, the outdoor unit and the plurality of indoor units being connected through the plurality of valve boxes, and each of the valve boxes having at least one of the indoor units connected therewith, the control method comprising:

calculating a cooling temperature effect deviation or a heating temperature effect deviation of each of the indoor units based on an indoor environment temperature of an environment in which the indoor unit is located and a set temperature;

calculating a total cooling effect deviation and a total heating effect deviation of the multi-connection air conditioning system based on horsepowers of all the indoor units and the corresponding cooling temperature effect deviations or heating temperature effect deviations; and selectively adjusting opening degrees of the valve boxes based on the total cooling effect deviation and the total heating effect deviation, wherein the control method further comprises:

calculating a valve box effect deviation of each of the valve boxes based on the horsepowers of all the indoor units connected to the same valve box and the corresponding cooling temperature effect deviations or heating temperature effect deviations; and wherein the step of "selectively adjusting the opening degrees of the valve boxes based on the total cooling effect deviation and the total heating effect deviation" further comprises:

selectively adjusting the opening degrees of the valve boxes based on the total cooling effect deviation, the total heating effect deviation, and the valve box effect deviations; and wherein the selectively adjusting the opening degrees of the valve boxes based on the total cooling effect deviation, the total heating effect deviation, and the valve box effect deviations further comprises:

determining a system correction value of each of the valve boxes based on the total cooling effect deviation and the total heating effect deviation, respectively;

determining a local correction value of each of the valve boxes based on the valve box effect deviation, respectively;

calculating a final correction value of each of the valve boxes based on the system correction value and the local correction value; and selectively adjusting the opening degree of the valve box based on the final correction value.

2. The control method for the multi-connection air conditioning system capable of simultaneous cooling and heating according to claim 1, wherein the determining of the system correction value of each of the valve boxes based on the total cooling effect deviation and the total heating effect deviation respectively further comprises:

calculating a first difference between the total cooling effect deviation and the total heating effect deviation;

judging a relationship of the first difference with a first preset threshold and a second preset threshold; and determining the system correction value of each of the valve boxes based on a correspondence between an operating mode of the outdoor unit, the first difference and the system correction value, if the first difference is smaller than the first preset threshold or larger than the second preset threshold;

wherein the first preset threshold is smaller than the second preset threshold, and the operating mode of the outdoor unit comprises a cooling mode and a heating mode.

3. The control method for the multi-connection air conditioning system capable of simultaneous cooling and heating according to claim 1, wherein the determining of the local correction value of each of the valve boxes based on the valve box effect deviation respectively further comprises:

calculating a second difference between a maximum value of the valve box effect deviations and a minimum value of the valve box effect deviations of all the valve boxes in the same working state;

judging a relationship between the second difference and a third preset threshold;

calculating an average effect deviation value of all the valve boxes in the same working state based on the valve box effect deviation of each of the valve boxes in the same working state and the number of the valve boxes in the same working state, if the second difference is larger than the third preset threshold;

comparing a magnitude of the valve box effect deviation of each of the valve boxes in the same working state with a magnitude of the corresponding average effect deviation value; and determining the local correction value of each of the valve boxes in the same working state based on a comparison result, respectively;

wherein the working state of the valve box comprises a cooling state and a heating state.

4. The control method for the multi-connection air conditioning system capable of simultaneous cooling and heating according to claim 1, wherein the calculating of the final correction value of each of the valve boxes based on the system correction value and the local correction value further comprises:

calculating a sum of a weighted value of the system correction value and a weighted value of the local correction value as the final correction value.

5. The control method for the multi-connection air conditioning system capable of simultaneous cooling and heating according to claim 1, wherein when adjusting the opening degree of the valve box, the control method further comprises:

judging whether the adjusted opening degree of the valve box is smaller than a minimum opening degree limit; and if yes, adjusting the opening degree of the valve box to the minimum opening degree limit.

6. The control method for the multi-connection air conditioning system capable of simultaneous cooling and heating according to claim 1, wherein each of the valve boxes comprises a high-pressure valve and a low-pressure valve, and the step of adjusting the opening degree of the valve box further comprises:

adjusting the opening degree of the high-pressure valve or the low-pressure valve which is in an open state in the valve box.

7. A control method for a multi-connection air conditioning system capable of simultaneous cooling and heating, the multi-connection air conditioning system capable of simultaneous cooling and heating comprising an outdoor unit, a plurality of valve boxes and a plurality of indoor units, the outdoor unit and the plurality of indoor units being connected through the plurality of valve boxes, and each of the valve boxes having at least one of the indoor units connected therewith, the control method comprising:

calculating a cooling temperature effect deviation or a heating temperature effect deviation of each of the indoor units based on an indoor environment temperature of an environment in which the indoor unit is located and a set temperature;

calculating a total cooling effect deviation and a total heating effect deviation of the multi-connection air conditioning system based on horsepowers of all the indoor units and the corresponding cooling temperature effect deviations or heating temperature effect deviations; and selectively adjusting opening degrees of the valve boxes based on the total cooling effect deviation and the total heating effect deviation, wherein the selectively adjusting the opening degrees of the valve boxes based on the total cooling effect deviation and the total heating effect deviation further comprises:

determining a system correction value of each of the valve boxes based on the total cooling effect deviation and the total heating effect deviation, respectively; and selectively adjusting the opening degrees of the valve boxes based on the system correction values; and wherein the determining of the system correction value of each of the valve boxes based on the total cooling effect deviation and the total heating effect deviation respectively further comprises:

calculating a first difference between the total cooling effect deviation and the total heating effect deviation;

judging a relationship of the first difference with a first preset threshold and a second preset threshold; and determining the system correction value of each of the valve boxes based on a correspondence between an operating mode of the outdoor unit, the first difference and the system correction value, if the first difference is smaller than the first preset threshold or larger than the second preset threshold;

wherein the first preset threshold is smaller than the second preset threshold, and the operating mode of the outdoor unit comprises a cooling mode and a heating mode.

8. The control method for the multi-connection air conditioning system capable of simultaneous cooling and heating according to claim 7, wherein when adjusting the opening degree of the valve box, the control method further comprises:

judging whether the adjusted opening degree of the valve box is smaller than a minimum opening degree limit; and if yes, adjusting the opening degree of the valve box to the minimum opening degree limit.

9. The control method for the multi-connection air conditioning system capable of simultaneous cooling and heating according to claim 7, wherein each of the valve boxes comprises a high-pressure valve and a low-pressure valve, and the step of adjusting the opening degree of the valve box further comprises:

adjusting the opening degree of the high-pressure valve or the low-pressure valve which is in an open state in the valve box.

* * * * *